US009962621B2

(12) United States Patent
Hoffend, Jr. et al.

(10) Patent No.: US 9,962,621 B2
(45) **Date of Patent: *May 8, 2018**

(54) COMPACT HOIST SYSTEM

(71) Applicant: Electronic Theatre Controls, Inc., Middleton, WI (US)

(72) Inventors: Donald Aloysius Hoffend, Jr., Alexandria, VA (US); Donald Aloysius Hoffend, III, Annandale, VA (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/613,259

(22) Filed: Jun. 4, 2017

(65) Prior Publication Data

US 2017/0266580 A1 Sep. 21, 2017

Related U.S. Application Data

(63) Continuation of application No. 13/725,831, filed on Dec. 21, 2012, now Pat. No. 9,700,810.

(51) Int. Cl.

| | |
|---|---|
| ***B66D 1/14*** | (2006.01) |
| ***A63J 1/02*** | (2006.01) |
| ***B66D 1/26*** | (2006.01) |
| ***B66D 1/56*** | (2006.01) |
| ***B66D 1/39*** | (2006.01) |

(52) U.S. Cl.

CPC ..... *A63J 1/028* (2013.01); *A63J 1/02* (2013.01); *B66D 1/26* (2013.01); *B66D 1/39* (2013.01); *B66D 1/56* (2013.01)

(58) Field of Classification Search

CPC .. A63J 1/028; B66D 1/39; B66D 1/36; B66D 1/741; B66D 1/74; B66D 3/18; B66D 3/26

See application file for complete search history.

(56) References Cited

U.S. PATENT DOCUMENTS

| | | | | |
|---|---|---|---|---|
| 3,428,298 A * | 2/1969 | Powell | ..... | B25H 1/0028 254/331 |
| 3,670,977 A * | 6/1972 | Boneck | ..... | B65H 75/38 242/390.8 |
| 3,776,367 A | 12/1973 | Grove | | |
| 4,118,907 A | 10/1978 | Small et al. | | |

(Continued)

FOREIGN PATENT DOCUMENTS

| | | |
|---|---|---|
| EP | 2455151 | 5/2012 |
| KR | 100888768 | 3/2009 |

OTHER PUBLICATIONS

EP13863800.2 Extended European Search Report dated Aug. 30, 2016 (7 pages).

*Primary Examiner* — Bradley Duckworth

(74) *Attorney, Agent, or Firm* — Michael Best & Friedrich LLP

(57) ABSTRACT

A hoist system having a drum primarily self-contained within a batten, for raising and lowering lighting, sound equipment, curtains and the like in a performance environment. The hoist system may be adapted with safety mechanisms including an overload sensor and/or a slack line detector. The system may be provided in the form of a point hoist. The compact system is highly scalable to a variety of spaces and applications, including school and public theaters and concert halls, as well as some homes, private business, etc.

18 Claims, 13 Drawing Sheets

(56) References Cited

U.S. PATENT DOCUMENTS 4,199,133 A * 4/1980 Gagnon ..... A63J 1/028 160/334
4,303,237 A * 12/1981 Hoffend, Jr. ..... A63J 1/028 472/78
4,662,628 A * 5/1987 Chatenay epouse Compagnone ..... A63J 1/028 254/278
4,892,203 A * 1/1990 Arav ..... B66D 3/26 212/331
5,101,215 A 3/1992 Creaser, Jr.
5,593,138 A * 1/1997 Zaguroli, Jr. ..... B66D 3/18 254/288
5,607,142 A * 3/1997 Nilsson ..... B66D 3/26 254/298
5,697,757 A 12/1997 Lindsay
6,158,555 A 12/2000 Brown, Jr.
6,253,502 B1 7/2001 Layton
6,634,622 B1 * 10/2003 Hoffend, Jr. ..... A63J 1/028 254/331
6,691,986 B2 * 2/2004 Hoffend, Jr. ..... A63J 1/028 254/331
6,889,958 B2 * 5/2005 Hoffend, Jr. ..... A63J 1/028 254/276
6,988,716 B2 * 1/2006 Hoffend, Jr. ..... A63J 1/028 254/331
6,997,442 B2 * 2/2006 Hoffend, Jr. ..... A63J 1/028 254/267
7,104,492 B1 * 9/2006 Massell ..... B66D 1/36 242/397
7,258,325 B2 8/2007 Hoffend, Jr.
7,293,762 B2 * 11/2007 Hoffend, Jr. ..... A63J 1/028 254/331
7,484,715 B2 * 2/2009 Hoffend, Jr. ..... A63J 1/02 212/98
7,607,644 B1 * 10/2009 Gibb ..... B66D 1/36 254/333
7,775,506 B2 * 8/2010 Hoffend, III ..... A63J 1/028 160/143
7,810,792 B2 10/2010 Hoffend, Jr.
7,854,423 B2 12/2010 Hoffend, Jr.
8,033,528 B2 10/2011 Hoffend, III
8,047,507 B2 11/2011 Hoffend, Jr.
8,286,946 B2 10/2012 Hoffend, Jr.
8,317,159 B2 * 11/2012 Hoffend, III ..... A63J 1/028 160/143
8,613,428 B2 * 12/2013 Hoffend, III ..... A63J 1/028 254/286
8,708,314 B2 * 4/2014 Scott ..... B66D 1/12 254/266
8,789,814 B2 7/2014 Hoffend, Jr.
8,905,702 B1 12/2014 Jedneak
2004/0098944 A1 * 5/2004 Hoffend, Jr. ..... A63J 1/028 52/843
2005/0104053 A1 * 5/2005 Miller ..... F21V 21/38 254/385
2006/0180564 A1 8/2006 Keppel
2007/0039783 A1 * 2/2007 Doran ..... B66B 11/0438 187/277
2008/0185564 A1 * 8/2008 LaFreniere ..... B66D 3/26 254/342
2009/0127527 A1 * 5/2009 Hoffend, III ..... A63J 1/028 254/338
2009/0140221 A1 6/2009 Kochan et al.
2010/0301292 A1 * 12/2010 Hoffend, III ..... B66D 1/741 254/338
2011/0193037 A1 8/2011 Smith
2014/0175353 A1 * 6/2014 Hoffend, Jr. ..... B66D 1/26 254/376

* cited by examiner

COMPACT HOIST SYSTEM

CROSS-REFERENCE TO RELATED APPLICATIONS

This application is a continuation of U.S. patent application Ser. No. 13/725,831, filed Dec. 21, 2012, now U.S. Patent No. 9,700,810, which application is hereby incorporated herein by reference in its entirety.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

Field of the Invention

The invention relates generally to an apparatus, system and method for moving a load. More specifically, the invention relates to a compact hoist system with potential applicability in a theater, concert hall or stage environment, for raising and lowering curtains, scenery, lights and the like, as well as in a variety of other home and business contexts.

Description of the Related Art

Conventional lift or hoist systems of a variety of types are known for use in theatrical or other performance environments. A typical system may include a large rectangular casing having therein a winch or other motor, a drive mechanism, a drum around which winds lifting or support cable, along with various controllers, sensors and safety mechanisms.

The mechanics of a conventional hoist system may be fixed to a framing beam or other secure, elevated structure of the performance location. Elongate cables or other members emerge from the mechanics, potentially re-routed by pulleys and other features prior to descending, and are typically connected to a batten or other structure to which are connected items to be raised or lowered, such as lights, speakers, curtains, etc.

An alternative implementation has the elongate members fixed to the overhead structure, with the other end of the elongate members descending downward toward and supporting the mechanics of the hoist, which move upward and downward along with the items to be raised and lowered, which commonly are connected to a batten attached to a body of the hoist.

Conventional hoist systems tend to be bulky, with asymmetrical enclosures and external battens, which may lead to a costly loss of space in cramped environments, complicated retrofit projects or, in cases of new construction, expensive custom designs.

SUMMARY OF THE INVENTION

The invention relates to a hoist system, method and apparatus. In one embodiment, the invention includes a hoist or lift contained within a compact structure. In a more specific embodiment, the invention seeks to offer a compact and highly adaptable self-climbing hoist system, at least some of the components of which are confined within an enclosure of the same. In a still more specific embodiment, the enclosure may be a tube or batten to which are attached items to be raised and/or lowered. The design of the invention is such that it may be scalable to a wide variety of sizes and applications.

In one aspect, a hoist in accordance with an embodiment of the invention includes a pipe batten or other object, for raising and lowering items under control of a motor-driven drum having wound around it an elongate member fixed to an elevated support, thereby raising and lowering the hoist upon rotation of the drum, wherein the drum is disposed within the pipe batten or other object. Depending upon a particular application, this arrangement may permit use of a hoist that is lighter, occupies less space and/or requires a motor having less torque, among other features, as compared to other hoist designs.

In another aspect, a batten in accordance with the invention may further act as a structure for supporting desired features, including light and sound fixtures, sources of electrical power, etc.

In another aspect, a point hoist is provided in accordance with an embodiment of the invention, moveable throughout a variety of locations such as for use for less permanent lifting needs.

In another aspect of the invention, a safety mechanism is provided by way of a slack-line detector, having a mechanism for detecting a reduced tension in a supportive elongate member, as may result from an object to be raised/lowered encountering an obstruction during lowering. In response to detecting slack on the line, the associated system may be partially or completely shut down, among other possibilities.

In another aspect of the invention, a safety mechanism is provided by way of an overload sensor, having a mechanism for detecting a load that exceeds a desired or recommended capacity of the associated hoist system. In response to a determination that an excessive load is present, the associated system may be partially or completely shut down, among other possibilities.

DETAILED DESCRIPTION OF THE INVENTION

In the following detailed description of the invention, reference is made to the figures, which illustrate specific, exemplary embodiments of the invention. It should be understood that varied or additional embodiments having different structures or methods of operation might be used without departing from the scope and spirit of the disclosure.

In one implementation, the invention comprises a self-contained, self-climbing hoist system, having a motor, and a drum around which winds one or more lengths of cable, rope or other elongate member, for lifting and lowering at least a portion of the system, thereby also lifting attached objects, with respect to a fixed support. Depending upon an intended application, the motor and drum may be partially or fully contained within a batten or other enclosure. A batten often takes the form of a pipe or tube batten, though other forms are contemplated. For example, the use of a length of material having a square or other polygonal, elliptical, or any other cross-section might be beneficial, depending upon a particular application. Articles to be raised and lowered may be attached to the pipe directly, or indirectly, such as through a laddered arrangement of one or more additional pipes or other support mechanism, depending upon a particular application.

Figure 1:
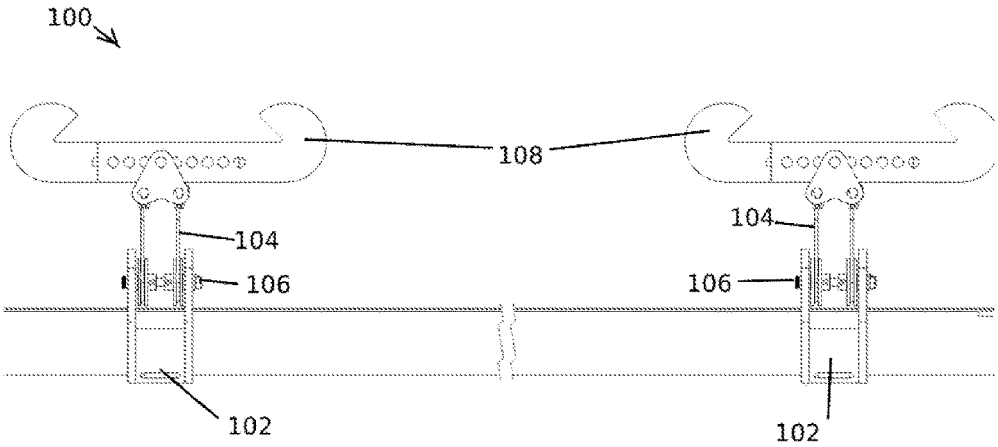
FIG. 1 is a partial perspective view of an embodiment of a hoist system in accordance with the invention, the view being truncated for illustration purposes.

An embodiment of the invention is illustrated by FIG. 1 as a hoist 100. In this embodiment, the hoist 100 is self-contained within a tube or pipe, here a batten 102. The size and/or shape of the batten 102, its method of manufacture, etc., may vary significantly depending upon a particular application. In one embodiment, the batten 102 is formed as an extrusion in a desired shape (i.e., cross section, generally, through the use of a die). The shape may be chosen for ease of attachment of a wide variety of attachments (temporary or permanent), including light fixtures, sound elements, power outlets, etc.

The batten 102 as illustrated houses a motor and drum. Powered by the motor, the drum rotates about an axis that may be substantially shared by the batten 102, spooling or winding an elongate member 104 around the drum. As explained in greater detail herein, the drum may, during rotation, further move in a direction parallel to its center axis and at a predetermined distance/rate with respect to the rotation, such that as the elongate member 104 encircles the drum, successive lengths thereof lay in direct contact with the drum, rather than the elongate member piling 104 atop itself.

The drum may further be adapted with grooves or ridges for receiving the successive lengths of the elongate member 104, such that an outer diameter of the combination of the drum and wound elongate member is 1) greater than an outer diameter of the drum itself by an amount less than a diameter of the elongate member, or 2) not increased at all by the elongate member 104, in a case that the elongate member 104 fits entirely within the grooves. In an application where elongate members 104 fit fully within grooves of the drum, a batten 102 may be chosen such that, as elongate members 104 encircle the drum, the batten 102 prevents the elongate members 104 from leaving the grooves, although tension on the elongate members 104 may not be fully maintained. In either case, this feature may enable a more compact design, e.g., the use of a tube of a relatively smaller diameter, depending upon a particular application.

An elongate member may be connected to a drum and adapted to wind thereabout in a variety of ways. In one embodiment, a drum is adapted to receive two elongate members 104 (or two lengths of a continuous elongate member 104 as further discussed herein) at an end. Thus, the grooves may be formed as a double-lead helical groove, i.e., double-start drums may be used. Three (triple)- or further multiple-lead arrangements are contemplated as well, depending upon a particular application. A multi-lead arrangement may increase strength and reliability over a single lead, provide redundancy as a safety measure, decrease noise and/or component wear, etc. For example, instead of an arrangement having two 3/32" leads, a single 1/8" lead, three 1/16" leads, etc., might be substituted, depending on needs. Although the wire ropes may be in close proximity, they do not cross over each other as they wind onto the drum. This may extend the life of a wire rope on average, avoiding the additional physical stresses that may occur through the piling of the rope, crossing over, etc.

As further described herein, a batten and drum may cooperate in a variety of ways. In one embodiment, a drum is entirely encompassed by a batten having the same shape as the drum, with the batten having an internal diameter (and circumference) only slightly larger that an external diameter (and circumference) of the drum. In certain applications, the difference may be on the order of a few thousandths of an inch, for example. The design parameters of the drum and batten may alternatively be such that the two surfaces are intended to remain in slight contact during operation, where the surface of the drum may be interrupted by grooves for receiving a wire rope. A depth of grooves in the drum may likewise be on the order of a few thousandths of an inch deeper than a diameter of the wire ropes.

In such an embodiment and others, materials for the batten and drum may be chosen accordingly. For example, a drum may be formed from a glass-filled nylon or other low-friction material with respect to a steel batten, among a number of other contemplated materials pairs.

Other factors contributing to a chosen tube diameter might include the nature of the cable or other elongate member. Winding a cable upon a small-diameter drum might degrade the cable over time, due to physical stresses within the strands or other material of which it is formed, imparted when the cable is over-flexed upon being wound. The use of a larger diameter drum might lessen these stresses, depending upon the relative diameters involved, the nature of the elongate member, etc.

In many applications, it is desirable to attach a hoist to a fixed, elevated structure. As shown in the exemplary embodiment of FIG. 1, the elongate member 104 emerges from the batten 102 through an opening, and may be used to couple the hoist assembly 100 directly or indirectly to an overhead structure or other support. Specifically, the elongate member 104 in FIG. 1 passes through a double sheave assembly 106, and is connected to a beam clamp 108 by any of a variety of means, as further described herein. The beam clamp 108 may be attached as desired to an elevated structure, such as an overhead beam in a concert hall or theater setting, among numerous other potential applications. Other means of installing a hoist assembly for use are contemplated, as would be understood by one skilled in the art.

The elongate member 104 may be fabric rope, wire rope or cable, among others. In one embodiment, four approximately 0.28 (3/32") inch wire ropes are used, though countless variations are contemplated, depending upon a variety of factors. In another embodiment, approximately 0.28 (3/32") inch wire ropes are attached at a separation of 1.125 (1 1/8) inch and wound at a 1/4 inch pitch (i.e., 4 grooves per rope per inch, i.e., 8 grooves per inch for a dual-rope, double-start drum). Single-rope hoists are contemplated as well, as for lighter-duty applications. Larger diameter or more numerous ropes, with the same or larger diameter drums, may be used for heavier duty applications.

As illustrated by FIG. 1, an elongate member 104 may be comprised of multiple (as shown, 2) strands of rope. In one embodiment, a single strand of elongate member 104 is connected at both ends to a beam clamp 108 or other means of attachment, while a body of the member 104 passes unbroken through the double sheave assembly 106 or other suitable means of attachment to the batten 102. This continuous U-shaped length of elongate member 104 may further be fitted with, for example, a compression sleeve (see FIG. 6), such that if one of the two (in this embodiment) substantially parallel lengths of member 104 breaks, the other does not pull through the assembly 106, and maintains its support of the hoist assembly 100. A compression sleeve may likewise be used to couple the ends of two separate elongate members 104 in an embodiment where two strands are used, or in a single-strand embodiment in which the continuous end is disposed within or near the beam clamp 108.

Figure 2:
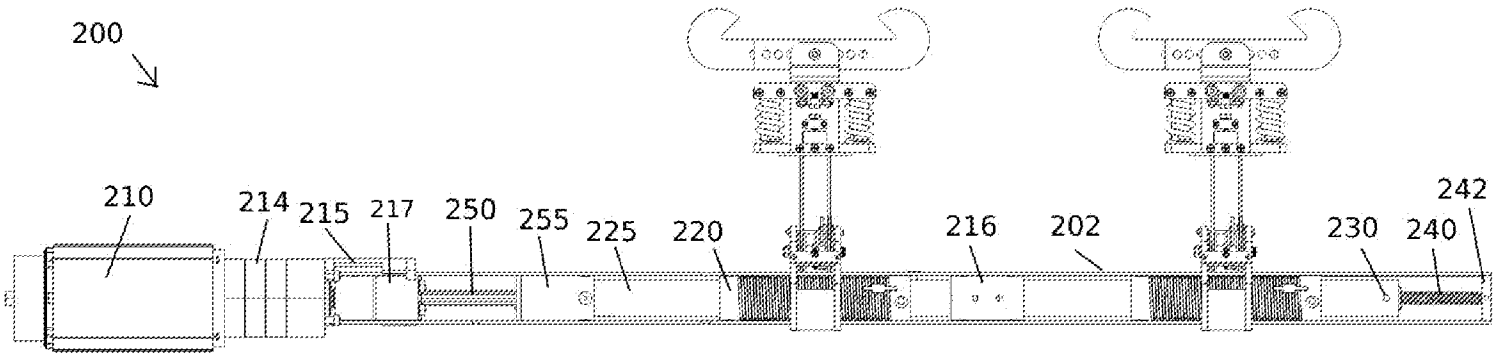
FIG. 2 is a perspective view of an embodiment of the internal mechanics of a hoist system in accordance with the invention.

FIG. 2 illustrates components of an embodiment of a hoist system 200 that may be internal to an enclosure or tube, for example a batten 102 as in FIG. 1 or a pipe batten 202 (illustrated transparently except for an outer periphery) as in FIG. 2, in accordance with the invention. Depending upon a particular application, an internal mechanism of the hoist system 200 might include a wide range of components, for example a motor 210, a gearbox 214, a gear mount to pipe batten coupling 215, a motor shaft to spline shaft coupling 217, a shaft coupling 216, a drum 220, a drum shaft or axle 225, a nut collar 230 fixed within the drum 220, an acme screw 240, a spline outer race housing 255, and a spline shaft 250 (see also FIG. 3 and description). In one embodiment, a motor 210 is coupled to and drives a drum 220 via a spline shaft 250, through which the motor 210 is able to impart a rotational force while allowing the drum 220 to slide, within a predetermined space, along the spline shaft 250. The spline shaft might further be connected to the acme screw 240 via the drum axle 225.

In operation, these components may share a center axis, or various components may be offset as desired, with certain components potentially disposed outside of the tube, depending upon constraints including space, lift capacity required, etc. For example, it might be desirable due to space constraints that the motor be disposed in an offset position, parallel to and coupled to the drum 220 using gears or other suitable means, such that a length of the tube and/or overall apparatus might be lessened.

Figure 3:
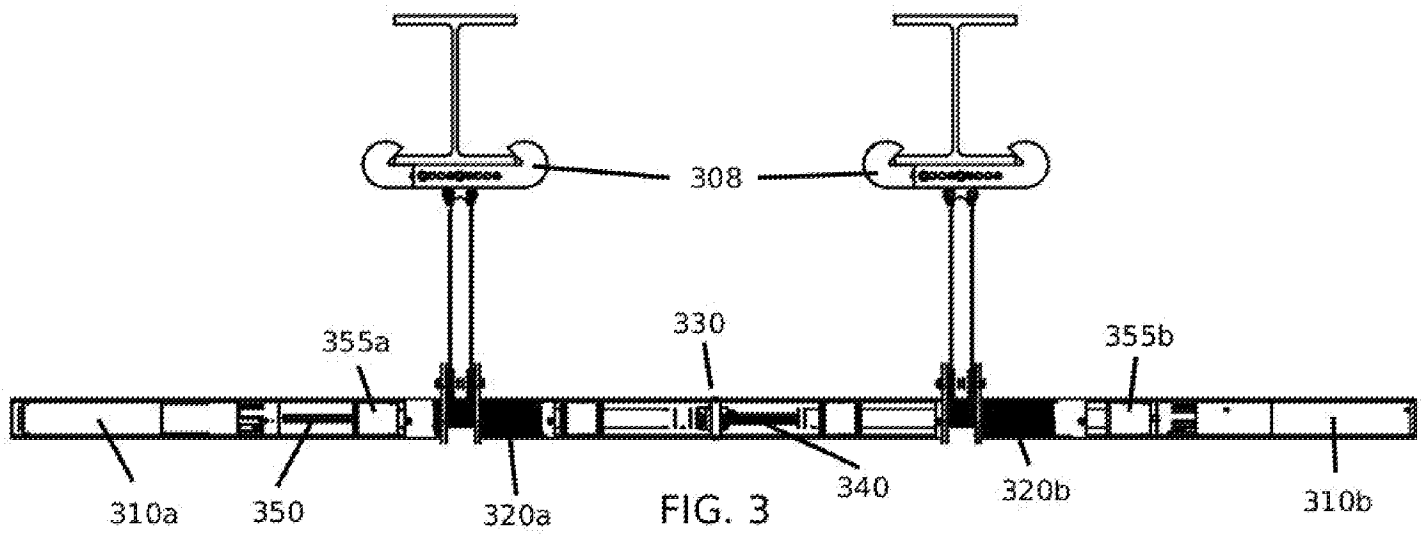
FIG. 3 is a perspective view of a dual-motor embodiment of a hoist system in accordance with the invention.

In one embodiment in accordance with the invention, as illustrated by FIG. 3, a hoist system 300 includes two motors 310*a* and 310*b* for driving two drums 320*a* and 320*b* disposed between the two motors 310*a* and 310*b*, one disposed at each approximate end of the associated enclosure, which may be a box, case, etc., here assumed for purposes of illustration to be a batten or other tube-like structure. Alternatively, the motors 310*a* and 310*b* or a single dual-drive motor might be disposed in an approximate center along a length of batten, or offset and having a nut collar or analogous feature at an approximate center, for driving the drums 320*a* and 320*b* positioned outwardly from the center, depending upon a particular application.

An operation of an implementation of a hoist system in accordance with the invention is described herein in the context of a dual-motor embodiment, with the associated concepts applicable as well to a single-motor embodiment, in accordance with the skill in the art. In another embodiment, a single motor, which might need to be of increased power in certain applications, is disposed at one end of a pipe or other enclosure, to drive one (1) or more drums about an acme screw fixed at the second end. For example, in a large venue application, e.g., an airplane hangar or terminal, a hoist of 300 or more feet might be needed, in which case it may be desirable to chain 15, 30 or more drums together. The invention is in that sense and others scalable and adaptable to a wide variety of potential implementations.

As described herein, the hoist system 300 might be designed such that, upon operation of the motors 310*a* and 310*b*, an approximately horizontal (assuming a normal operating position) translation of the drums 320*a* and 320*b* occurs.

In one embodiment, casings of the motors 310*a* and 310*b* and a nut collar 330 are fixed with respect to the tube, while rotors of the motors 310*a* and 310*b*, the drums 320*a* and 320*b*, an acme screw 340 and a spline shaft 350 are fixed with respect to each other, and turn within the tube. In addition to rotating within the tube, the drums 320*a* and 320*b* might be adapted for lateral (generally horizontal, assuming a normal operating position) movement along the spline shaft 350 by virtue of a pair (in a dual motor environment) of sliding couplers, herein spline couplers 355*a* and 355*b*, rotationally coupling each of the drums 320*a* and 320*b* to the spline shaft 350, i.e. transferring the driving force thereto, while allowing the drums 320*a* and 320*b* to respectively slide along the spline shaft 350 upon rotation, as described herein.

For example, an assembly of the two drums 320*a* and 320*b* and an acme screw 340 connecting them might be disposed in relation to the nut collar 330 such that upon rotation the two drums 320*a* and 320*b* move in unison along spline shaft 350, either toward one motor 310*a* or the other motor 310*b*, depending upon a direction of rotation. For example, the fixed-position nut collar 330 might be threaded to mate with threads of the acme screw 340, thereby imparting a generally horizontal force upon rotation of the acme screw 340 with respect to the respectively fixed nut collar 330. The resulting horizontal translation allows elongate members entering a fixed cutout in the tube to wrap around the drums 320*a* and 320*b* as the drums 320*a* and 320*b* rotate. Alternative arrangements leading to a similar result are possible as well.

In an alternative embodiment, the drums 320*a* and 320*b* move inward toward each other or outward away from each other, depending upon a direction of rotation of the motors 310*a* and 310*b*. Multiple nut collars 330 might be used or, as another example, one shaft might be threaded internally within another, etc., thus pulling the shafts inward. A relative direction of rotation of drums 320*a* and 320*b* is variable as well. For example, whether under control of a single or multiple motors 310*a* and 310*b*, the drums 320*a* and 320*b* might rotate in the same or opposite directions, either consistent with the directions of rotation of the motors 310*a* and 310*b* or, as in a single-motor embodiment, through the use of differentials to switch a direction of rotation inline. In one embodiment, depending upon an angle of exit of an elongate member from a batten, multiple such exits at the same angle along an outer periphery (e.g., circumference) of a batten (as might be the case when using drums that rotate in unison) might naturally lead to a torque being imparted on the batten. Utilizing drums rotating in opposite directions, with corresponding rope exits being on opposite sides (for example, at 10 o'clock and 2 o'clock, or 9 o'clock and 3 o'clock positions, about a cross-sectional periphery of a batten) of the batten, might beneficially lessen or eliminate (by counteraction) a collective torque on the batten.

Figure 4:
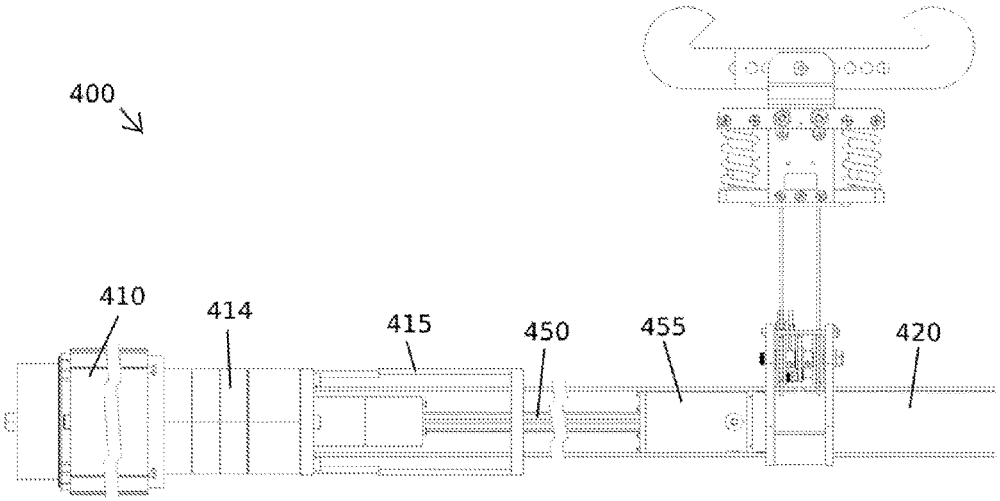
FIG. 4 is a perspective view of an embodiment of the internal mechanics of a hoist system in accordance with the invention.

As noted herein, an embodiment of a hoist 400 is contemplated in which a driving source, such as a motor 410, is disposed outside of a pipe 402, as illustrated by FIG. 4. The motor 410 in this embodiment is coupled to a threaded drive shaft such as a spline shaft 450 through an optional gear box 414 and pipe batten-to-gearbox coupling 415. A gear box 414 might allow use of a motor 410 having less horsepower or lower torque, which may be a tradeoff for higher revolutions-per-minute (RPM) to achieve a comparable lifting action (speed, maximum load, etc.). Pipe batten-to-gearbox coupling 415 connects and prevents respective motion between the pipe 402 and the gearbox 414.

Figure 5:
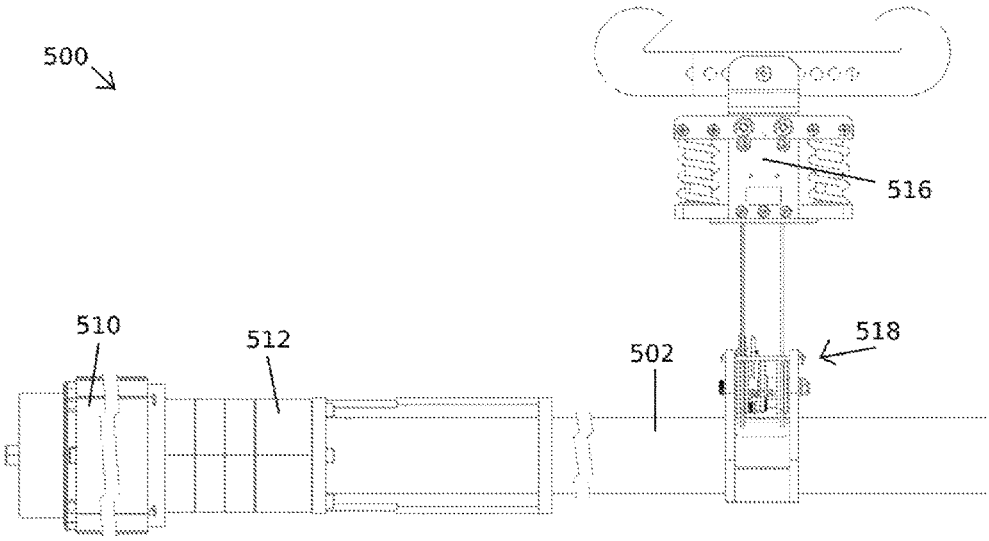
FIG. 5 is a detailed perspective view of an embodiment of a mechanism for connecting a batten to an overhead support in accordance with the invention.

A pipe batten 502, the position of which may be seen in FIG. 5, has been rendered transparent in FIG. 4 to better illustrate internal features such as a drum 420, a spline shaft 450 and a spline outer race to drum shaft coupling 455. In this embodiment, the spline outer race to drum shaft coupling 455 couple the spline shaft 450 to the drum 420, such that as the spline shaft 450 rotates under the power of the motor 410, the drum 420 translates parallel to a center axis (e.g., of rotation) of the spline shaft 450 (and in this embodiment, an axis of the motor 410). It is also contemplated that an axis of the motor 410 be offset from an axis of the spline shaft 450 if desired, such as to accommodate for space limitations.

It may further be seen in connection with FIGS. 4 and 5, as further described herein, that a batten 502 may be chosen to be only slightly larger than an outer surface (i.e., the lands of any grooves) of the drum 420. This may have the effect of, as wire ropes enter the batten 502 to be wound upon the drum 420, physically maintaining the wire ropes within the grooves around nearly an entire circumference of the drum 420 (in one embodiment, on the order of 340 degrees of the circumference).

FIG. 5 generally represents the view of FIG. 4 as a hoist system 500 having a motor 510 and a gearbox 512, without the transparency of the batten 502. In addition to the features described in the context of particular embodiments of the invention, it is contemplated that the features be variously used in other applications, and additional features are contemplated as well, including an overload sensor 518 and slack line detector 558, described in greater detail with respect to FIGS. 8 and 9, respectively.

Figure 6A:
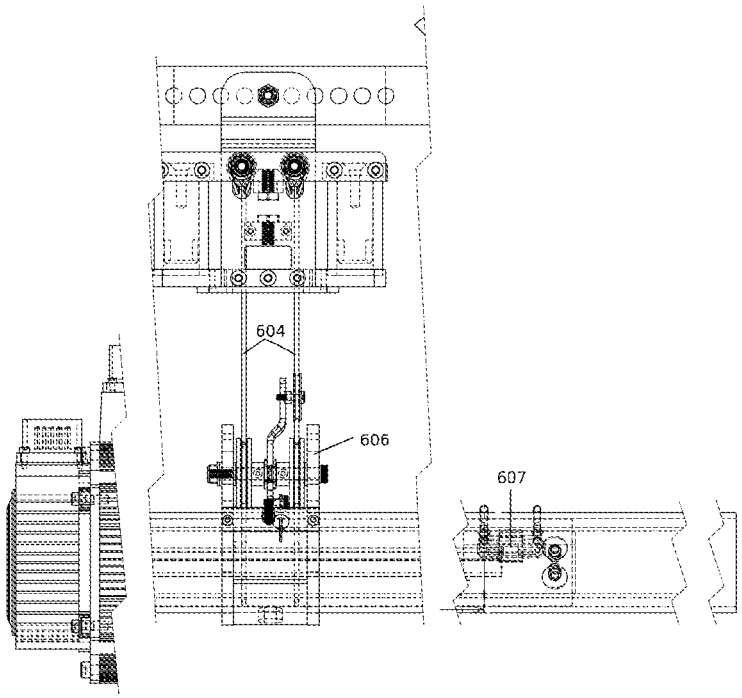
FIGS. 6A and 6B are detailed perspective views of an embodiment of a mechanism for connecting a wire rope to a double sheave assembly in accordance with the invention.
Figure 6B:
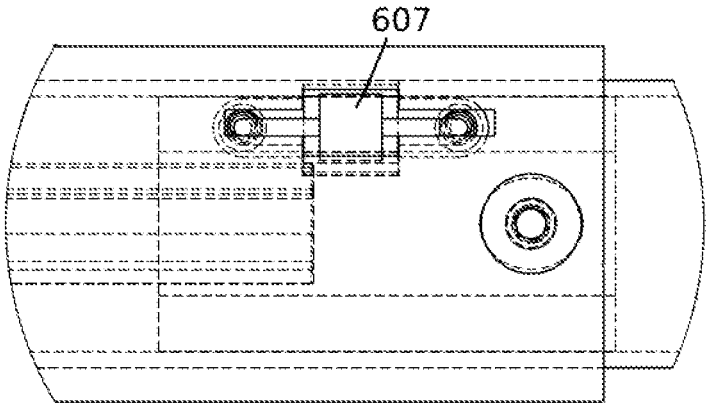

FIGS. 6A and 6B illustrate an embodiment of a mechanism for connecting a wire rope 604 and a sheave assembly 606. As discussed herein, a single length of wire rope 604 may be looped through the sheave assembly 606. In such an embodiment, it may be desirable to include an inline compression fitting 607, such that if the wire rope 604 fails in one of the two parallel portions, the hoist 600 will remain supported by the remaining length of wire rope 604, by virtue of the compression fitting preventing the wire rope 604 from freely pulling out of the assembly 606.

Figure 7:
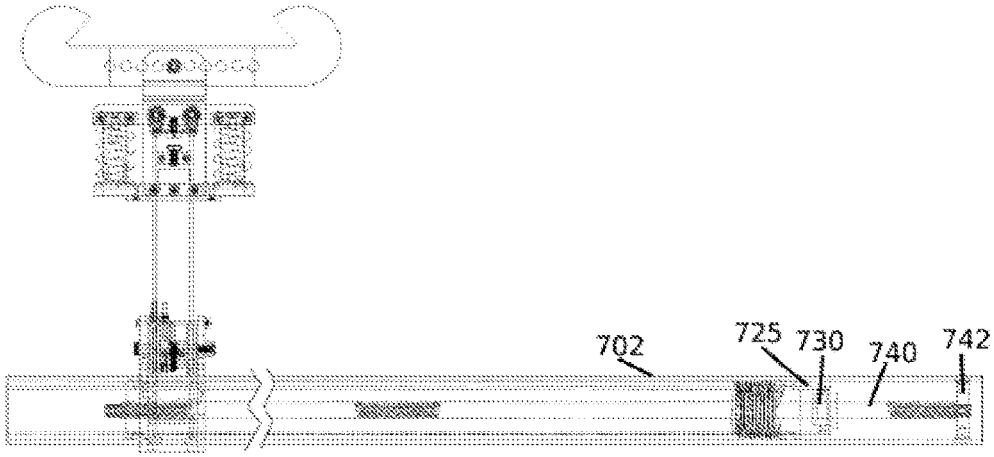
FIG. 7 is a detailed perspective view of the internal components of an embodiment of a hoist system in accordance with the invention.

An enlarged view of the cooperation between a drum shaft 725, an acme nut 730 and an acme screw 740 in accordance with an embodiment of the invention is provided by FIG. 7. The acme screw 740 in this embodiment is coupled to an interior wall of the pipe batten 702 by an acme screw anchor 742. As disclosed herein, as the acme screw 740 turns with respect to the screw anchor 742 (and pipe batten 702), the acme screw 740 and the drum (not shown) is drawn or pushed in a direction substantially parallel to the length of the pipe batten 702, depending upon a direction of rotation of the acme screw 740. Alternatively, the acme rod 740 may be held fixed, while an acme nut, e.g., screw anchor 740 is attached to the drum. As the acme nut 740 turns, it travels along the acme rod 740, moving the drum laterally.

Figure 8A:
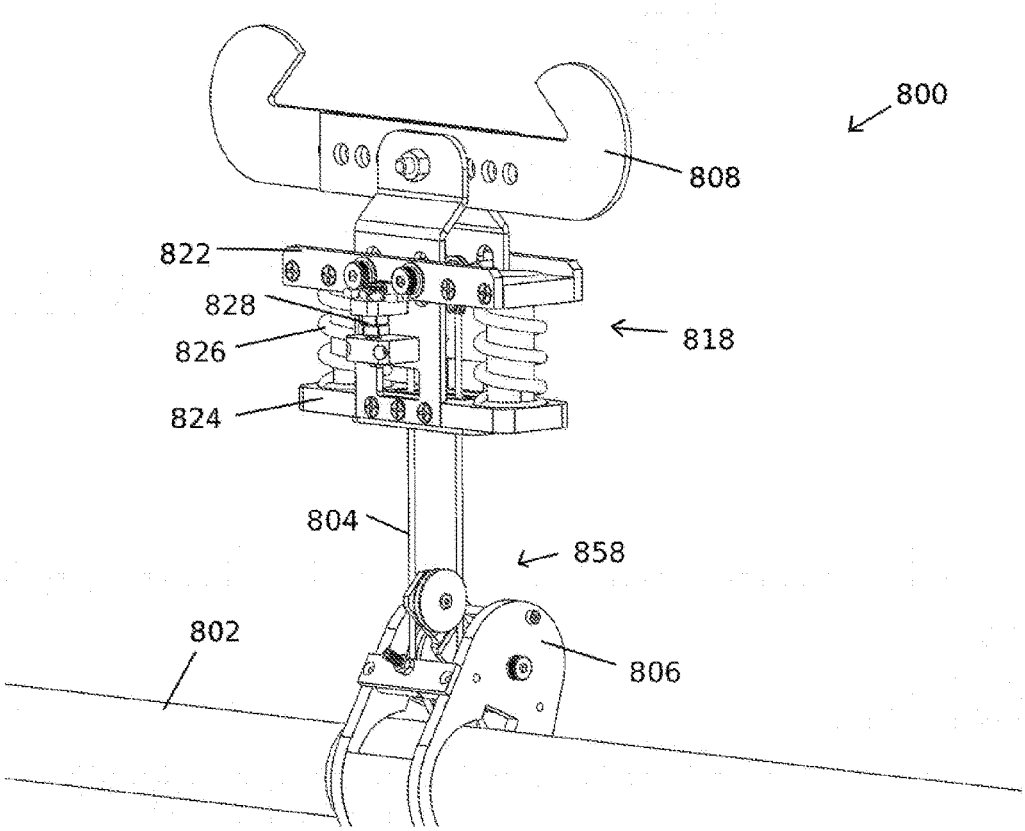
FIGS. 8A and 8B are a perspective view and sectional view respectively of an overload sensor in accordance with an embodiment of the invention.
Figure 8B:
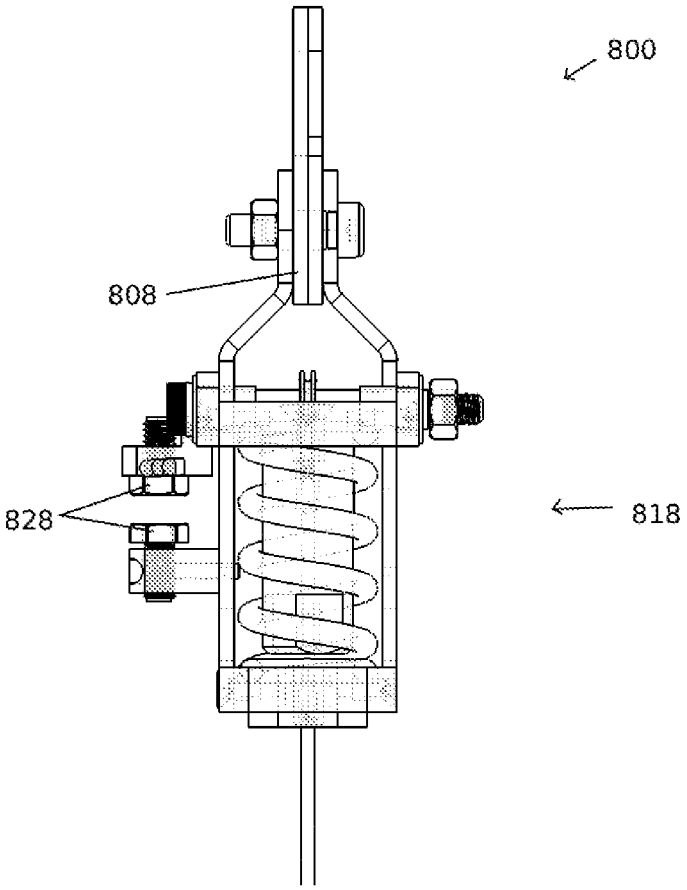

FIGS. 8A and 8B illustrate an embodiment of an overload sensor 818*a* and 818*b* that might be provided for use with a hoist 800 in accordance with the invention, such that if too great a load is placed upon the hoist 800, a portion or all of the overall system is disabled. In one embodiment, between a beam clamp 808 (or other suitable support mechanism) and a sheave assembly 806 (or other suitable attachment mechanism) are disposed a fixed bracket 824 coupled to the beam clamp 808 and moveably coupled to a sliding bracket 822. Between the fixed bracket 824 and the sliding bracket 822 may be disposed one or more compression springs 826 or other resistive means to assert a certain amount of resistive force against the movement of the sliding bracket 822 in the direction of the fixed bracket 824, each bracket having one or more ground-out contacts 828 that come into contact with each other upon a sufficient displacement of the sliding bracket 822 toward the fixed bracket 824. A strength of the springs 826 or other resistive means may be chosen such that contact between the contacts 828 only occurs under a pre-determined sufficiently great load has been placed on the elongate members 804. Contact between the contacts 828 may be designed to create a condition, such as an electrical ground-out, switch actuation, etc., sufficient to disable at least a portion of the system 800*a* to avoid operation during an overload situation.

In one embodiment, an internal shaft (e.g., drum shaft 725 in FIG. 7) is energized, for example with 24 volts or other appropriate potential, which will be electrically isolated, and which will energize at least one of the wire ropes (also electrically isolated, as by the drum), while the pipe 802 is connected to electrical ground through the motor. When the springs 826 of the overload sensor 818 are compressed (due to too much weight on the batten), the contacts 828, illustrated in the form of bolt heads, will contact each other, creating a ground-out situation through connection to the building steel or other support structure for example, stopping the pipe 802. Limiting the electrical current (in one embodiment, only 200 milliamps) running through the wire rope 804 can eliminate or reduce the risk of a harmful electrical shock if a person were to come into contact with the wire rope 804.

Another feature that might be offered in conjunction with the hoist electrical arrangement disclosed herein is a limit selector for controlling an operating range of motion (e.g. lifting range) of a hoist. In one embodiment, in which a drum translates as it rotates, a controller may be provided in connection with a moveable switch (not shown) placed in a path of the drum. The switch may be positioned such that when the drum translates to a certain location (corresponding to a certain lift position), the drum actuates the switch, in connection with the ground-out system, for example, to prevent further translation (and thus rotation) of the drum in the same direction (though it may still be reversed to lower a load to the extent of a second limit position). Through selection of positions of limit switches, the operable range of a hoist system might be variably chosen. FIG. 8 further illustrates a slack line detector 858, as described in greater detail herein with respect to FIGS. 9A and 9B.

Figure 9A:
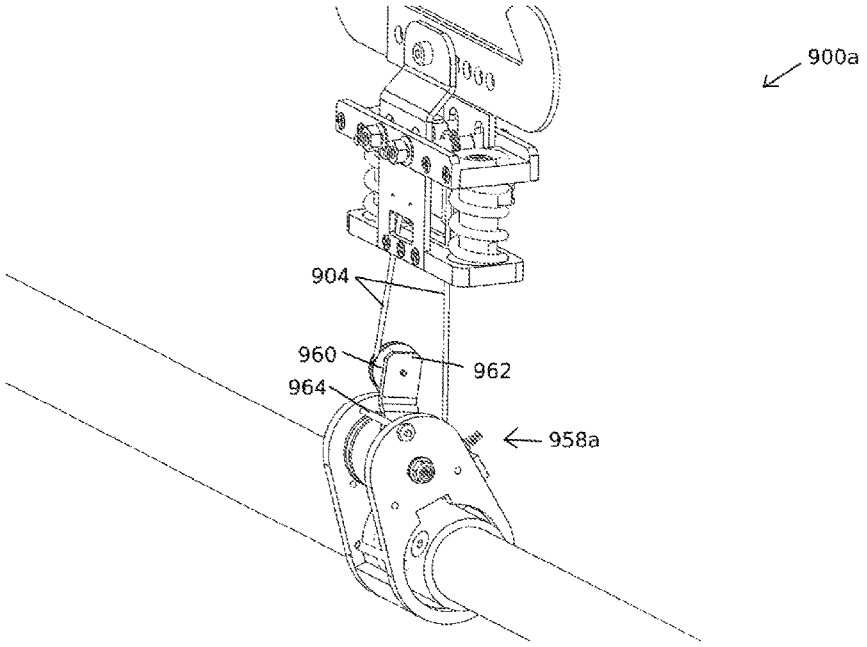
FIGS. 9A and 9B are perspective views of alternative embodiments of a slack line detector in accordance with the invention.
Figure 9B:
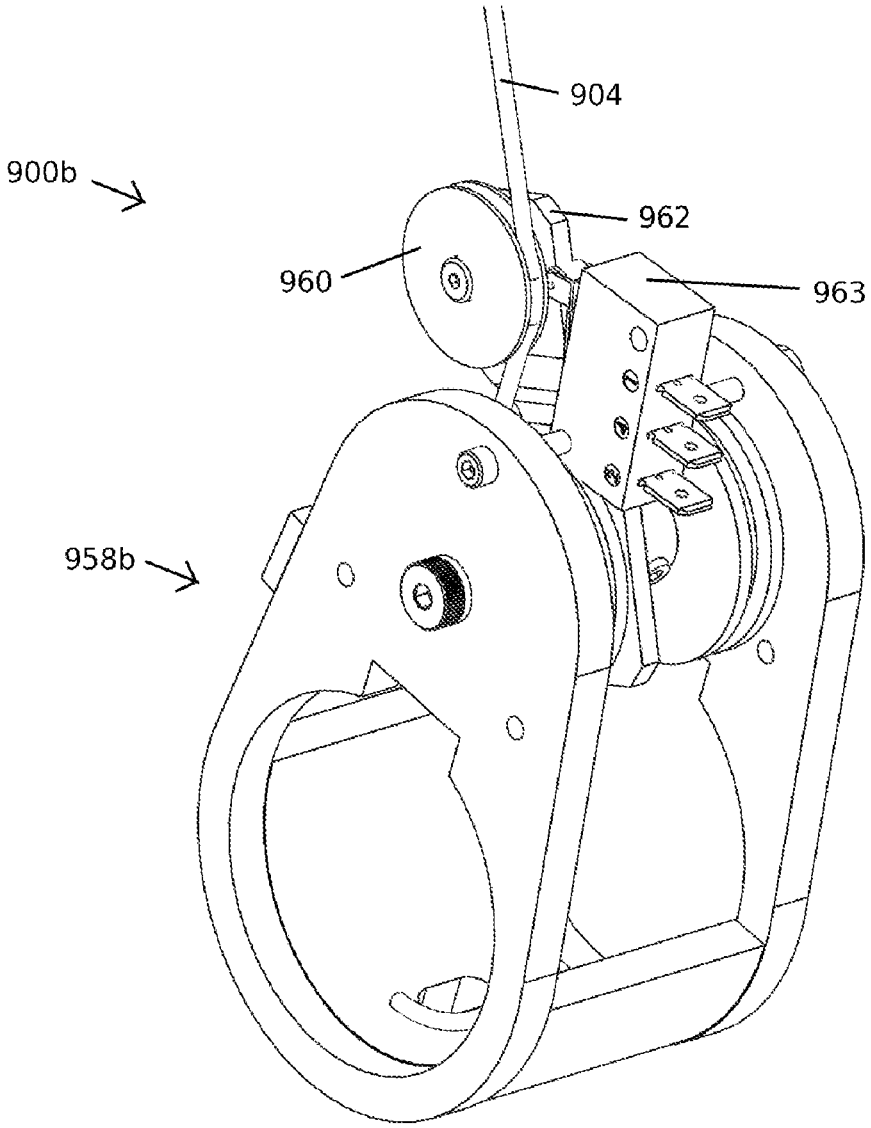

FIGS. 9A and 9B illustrate embodiments of a hoist 900 adapted with slack line detectors 958*a* and 958*b* for detecting a condition in which an expected tension on an elongate member 904 releases, as may occur when a load to be hoisted encounters an obstacle while being lowered. A slack line detector 958*a* may serve as an alternative to a ground out bar, which may run the length of, and parallel to, a drum, such that when a wire rope goes slack, it pulls or falls away from the grooves of the drum, contacting the ground out bar and stopping the system. The slack line detector 958*a* may be adapted to work in a variety of ways. In one embodiment, a tensioned (e.g., spring loaded) rocker arm 962 having a pulley 960 is positioned such that upon action of the spring or tensioning device (not shown) the arm 962 is contact with a bar 964 (see FIG. 9A). When the pulley 960 is disposed against a taut wire rope 904, the rocker arm 962 is pulled away from the bar 964 (see FIG. 8A). When the wire rope goes slack, the spring loaded arm 962 moves to contact the bar 964, creating a ground-out condition through connection to the detector 958*a*, which is connected to the grounded pipe, for example.

As described with respect to an overload sensor, one of the wire ropes 904 may be electrically charged while another wire rope 904 is electrically isolated, in which case contact between the wire ropes 904 will cause a ground out situation, stopping the system. The small pulley 960 may be formed from a metal or other conductive material, with the arm 962 being electrically isolated, such that it will ground upon contact with the small bar 964 to stop the system. In another embodiment, the arm 962 of a slack line detector 958*b* instead contacts and activates a micro-switch 963, electrically sending a signal to the motor to stop, as illustrated by FIG. 9B.

Figure 10:
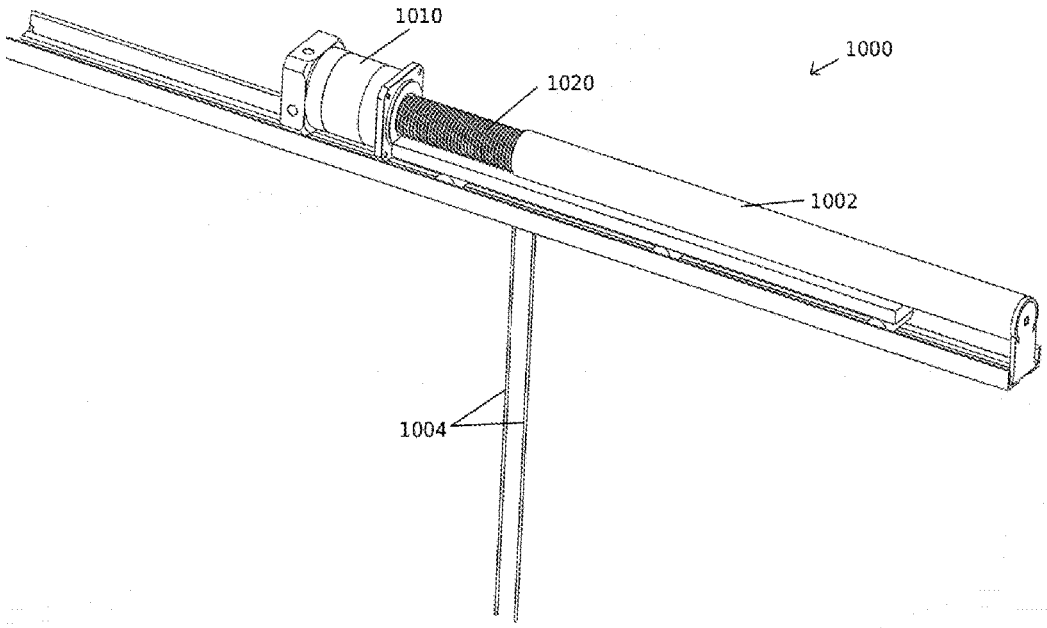
FIG. 10 illustrates a perspective view of a point hoist in accordance with an embodiment of the invention.

In another embodiment, a hoist is provided in the form of a type of movable point hoist, an embodiment of which is illustrated by FIG. 10. In a point hoist 1000, a motor 1010 may be attached to a drum 1020, which is drawn inward into a pipe or cover 1002 as the drum 1020 rotates, drawing up wire ropes 1004 and lifting or lowering an object or structure as desired, as described herein. In this embodiment, an acme rod 1040 would be held stationary (with respect to any translation along its length), while the drum 1020 would translate as it turns, drawing the assembly into the pipe or cover 1002. A point hoist may be mounted to a simple aluminum channel, for example, as opposed to being inside a pipe. This channel could be mounted to a grid or other means above the stage, etc. and could be moved to different positions. The motor 1010 and drum 1020 may be mounted on bearings or other low friction or otherwise slide-friendly surface within the channel. In one embodiment, a point hoist will weigh approximately 50 pounds for ease of movement. As noted, in certain applications a point hoist 1000 has a drum 1020 that is not necessarily confined within a pipe 1002, which may permit use of a larger diameter wire rope (⅛ inch, 3⁄16 inch, etc.), which may enable lifting a heavier load.

Figure 11:
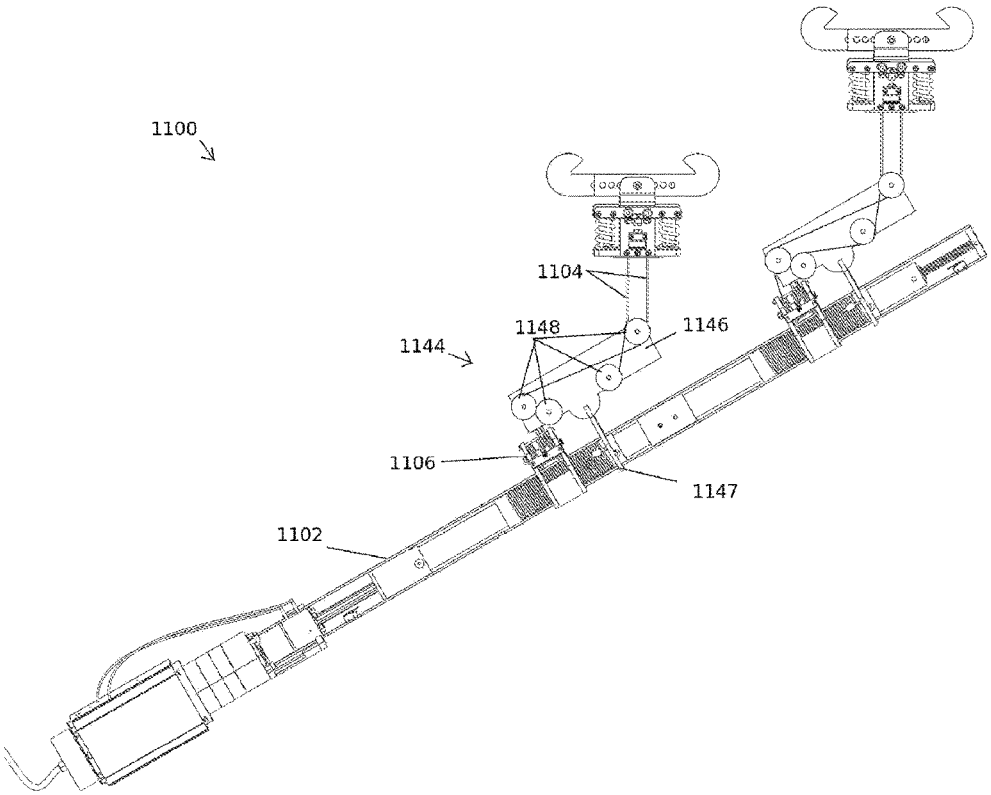
FIG. 11 illustrates a perspective view of an embodiment of a diverter pulley system in accordance with the invention.

Herein, various hoist systems have been illustrated by way of example as primarily having elongate members exiting a batten or related structure and extending substantially vertically, such as to fixed overhead locations. It should be noted, however, that a hoist system in accordance with the invention is further versatile in this aspect. FIG. 11 illustrates a hoist system 1100 with a batten 1102 having connected thereto a double sheave assembly 1106 that has been adapted for use with a diverter pulley system 1144. The pulley system 1144 is formed from a bracket 1146 coupled to the batten 1102 along its length by a mount 1147. The pulley system 1144 is mounted a distance from a sheave assembly 1106 to divert elongate members 1104 approximately laterally along the batten 1102 through the use of pulleys 1148, in order adapt to varying overhead attachment locations and scenarios.

In the exemplary embodiment illustrated, the bracket 1146 is formed from a unitary piece of material, adapted for a predetermined overhead location, however it may alternatively be formed from multiple individual pieces, in one embodiment having a set of pulleys 1148 positioned near the sheave assembly 1106, and another set of pulleys 1148 attached to a second bracket, moveable along a length of the batten 1102. Alternatively, such a bracket 1146 assembly may slide to lengthen, to adapt for varying points of overhead attachment. As illustrated by FIG. 11, a hoist system 1100 of the type shown may also accommodate scenarios in which overhead support structures are at an angle (i.e., not level) and/or in which the batten 1102 itself is desired to be used at an angle, independent of an orientation of overhead support structures.

Within the broader concept of a compact hoist system in accordance with the invention, many specific implementations are contemplated, along with various alternatives. With respect to exterior dimensions, in one embodiment, an enclosure (e.g., batten, etc.) having a diameter of 2.125 (2 and ⅛) inches and 20 feet in length is utilized with two-foot drums. Some scalability might be achieved by varying the length and/or size of various components, while more extreme scalability might be achieved by coupling multiple such apparatus end to end, or using only half (e.g., a single motor-drum combination), which itself might be scaled as necessary, depending upon a particular application or environment.

Various motors might be used in accordance with the invention, depending upon a particular application, among them a variety of currently available tubular motors, or any of a variety of servo motors, such as stepper motors or other suitable drive unit, among others, in environments where it may be desirable to receive feedback regarding a motor's position.

An elongate member, e.g., rope, cable, etc., might be attached to a drum in a variety of ways. Multiple cables might be associated with a single drum or multiple drums. In one embodiment, a connector or sleeve facilitates installation of the member at one end to a drum. The end is pushed into the connector, which might sit in a cutout in the drum, and forced through spiral grooves or other features adapted to clamp or grasp the end, with a second end emerging through an opening in the batten. Outside of the batten, the elongate member might pass through a sheave assembly or other suitable means for supporting the batten. In one embodiment, the elongate member is attached at its other end with a thimble to a triangular or other shape block, as desired, which is attached to a beam clamp. In one embodiment, the beam clamp is formed from two partially overlapping J-shaped members, as illustrated herein.

While the description herein may refer to specific reference numbers in the figures, the description is likewise applicable to analogous elements having different numbers. For example, descriptions of features of a drum 220 may likewise apply to others such as drums 320*a* and 320*b*, etc., and components such as a drum 220 may be used with any other features, although they might only be disclosed herein with respect to another embodiment.

As noted above, battens are only one embodiment of an enclosure in accordance with the invention. The concepts of the invention may have applicability to other structures/enclosures, etc. as well, and numerous additional applications are further contemplated. For example, the inventions have been described primarily with respect to an enclosure that takes the form of a tubular structure, e.g., a circular, elliptical or otherwise rounded structure. As will be clear to one skilled in the art from the disclosure, however, other shapes, including square, rectangular and other polygonal and other shapes as well, depending upon a desired application. Nor is the invention limited to any particular material or structural framework. The concepts, methods and apparatus disclosed may be used in countless other applications not expressly mentioned herein without departing from the scope and spirit of the invention.

The inventions have been described for connection to an overhead support for lifting objects vertically, primarily in performance-type environments. Other implementations are contemplated, however, such as for pulling up an incline, and dragging/towing an object across a horizontal surface, among others, as well as in a variety of other venues and outdoors. An embodiment is also contemplated in which a vertical orientation of a hoist in accordance with the invention is substantially reversed, such that batten is mounted in an elevated position with elongate members extending outwardly therefrom, for attachment to an object to be lifted or moved.

As described herein, positional references and terms of orientation, such as overhead, elevated, above, below, horizontal, vertical, etc., herein assume a certain orientation of the described apparatus, are not intended to dictate precise angles or positions, and may be reversed or otherwise varied, depending upon the relative locations and orientations of the items involved.

A means for causing translation of a drum due to rotational motion is described herein by way of example as a rod having acme threading, but variations are contemplated. A variety of threading techniques are known, and the threads need not be trapezoidal in cross section and/or formed at any particular angle or pitch. Nor must a threaded rod be used at all where other drive means are available.

The inventions have been described in the context of a system whose primary mechanics (motors, drums, drive features, etc.) may be enclosed within a batten or other support enclosure. The system, however, might further include external features as described, including elongate members, mechanism for attachment to an elevated support, pulleys, sheave assembly, etc. In addition, various primary features might be disposed externally, depending upon a nature of the enclosure used and the application environment. Many features as well have been described as sharing a center axis, but a departure from this is likewise contemplated, as described herein. Furthermore, while the invention has often been described generally in the context of a smaller, more compact system, the concepts herein are applicable and scalable to much larger-scale operations as well.

In describing the inventions, various articles may be described as coupling or being coupled, connecting or being connected, attached, etc., to one another. This phraseology is not intended to exclude potential intermediate parts, i.e., coupling and connecting may be direct or indirect, unless otherwise limited.

What is claimed is:

1. A hoist system, comprising:

a first length of drum disposed about a first drum shaft and having a first elongate member coupled at one end to the first length of drum;

a first motor coupled by a spline shaft to the first drum shaft for imparting a rotational motion upon the first length of drum while permitting longitudinal motion of the first length of drum with respect to an axis of rotation of the first drum shaft, the elongate member winding about the first length of drum upon rotation of the first drum shaft in a first rotational direction; and a batten encasing the first length of drum and having an opening therein for permitting the elongate member to emerge therefrom, the elongate member having a second end adapted to be fixed to an elevated support structure for supporting the hoist system, the batten having a longitudinal axis substantially parallel to the axis of rotation of the first length of drum;

the hoist system being expandable by coupling a second drum shaft to the first drum shaft and disposing about the second drum shaft a second length of drum.

2. The hoist of claim 1, the second length of drum rotating in unison with the first length of drum, for winding a second elongate member about the second length of drum upon rotation of the first and second lengths of drum.

3. The hoist of claim 1, further comprising:

a differential coupling the second drum shaft to the first drum shaft such that second drum shaft rotates in a second rotational direction opposite the first rotational direction.

4. The hoist of claim 1, further comprising:

the batten having an internal diameter substantially similar to an external diameter of the first length of drum having spooled thereupon the elongate member, the first motor being disposed at a first end of the batten.

5. The hoist of claim 4, further comprising:

an acme screw fixed to the batten and coupled to the first drum shaft for imparting the longitudinal motion on the first drum.

6. A hoist system, comprising:

a first drum adapted to have coupled thereto a wire rope;

a motor coupled to the drum for imparting a rotational motion upon the first drum while permitting longitudinal motion of the first drum with respect to an axis of rotation of the first drum, the wire rope winding about the first drum upon rotation of the first drum in a first rotational direction; and a batten encasing the first drum and having an opening therein for permitting the wire rope to emerge therefrom, the wire rope having a second end adapted to be fixed to an elevated support structure for supporting the hoist system, the batten having a longitudinal axis substantially parallel to the axis of rotation of the drum, the batten having an internal diameter substantially similar to an external diameter of the drum having spooled thereupon the wire rope, the motor being disposed at a first end of the batten;

wherein the first end of the wire rope is coupled to the first drum, and the second end of the wire rope is coupled to an elevated support structure, supporting the hoist system in a position substantially vertically beneath the support structure, such that upon rotation of the first drum in the first direction with respect to the batten, the wire rope spools upon the first drum, shortening a length of wire rope outside of the batten, thereby lifting the hoist system substantially vertically toward the support structure.

7. The hoist system of claim 6, further comprising:

a first drum shaft, the first drum being disposed about the first drum shaft.

8. The hoist system of claim 7, further comprising:

a spline shaft coupling the motor to the first drum shaft for imparting the rotational motion upon the first drum while permitting the longitudinal motion of the first drum with respect to the axis of rotation of the first drum.

9. The hoist system of claim 7, further comprising:

a second drum shaft coupled to the first drum shaft, and a second drum disposed about the second drum shaft such that the second drum rotates in unison with the first drum, thereby increasing an operative length of the hoist system; and a second wire rope winding about the second drum upon rotation of the first and second drums.

10. The hoist system of claim 6, wherein the motor is substantially encased within the batten.

11. The hoist system of claim 6, further comprising:

an acme screw fixed with respect to the batten and coupled to the first drum by an acme nut, the interface of the acme screw with the acme nut imparting the longitudinal motion on the first drum.

12. The hoist system of claim 6, the batten further encasing at least a portion of the motor.

13. The hoist system of claim 6, further comprising:

slack line detection means for detecting a reduction in tension in the wire rope.

14. The hoist system of claim 6, further comprising:

overload sensing means for detecting that a load on the hoist system exceeds a predetermined limit.

15. The hoist system of claim 6, the batten having a substantially round cross sectional shape.

16. The hoist system of claim 6, further comprising:

a groove formed about a circumference of the drum;

wherein throughout at least a partial length of the drum, the batten is adapted to maintain the elongate member within the groove as the elongate member spools about the drum.

17. A hoist system, comprising:

a unitary drum shaft;

one or more hollow drums disposed about and fixedly coupled to the unitary drum shaft, each drum being adapted for connection of an elongate member thereto, and each drum having formed on an outer surface thereof, grooves for receiving the elongate member upon rotation of the drum;

a motor coupled to the unitary drum shaft for imparting a rotational motion upon the unitary drum shaft while permitting longitudinal motion of the unitary drum shaft with respect to an axis of rotation of the unitary drum shaft, the elongate member winding about the one or more drums upon rotation of the unitary drum shaft in a first rotational direction;

a batten encasing the unitary drum shaft and one or more drums, and having an opening therein for permitting the elongate member to emerge therefrom, the elongate member having a second end adapted to be fixed to an elevated support structure for supporting the hoist system, the batten having a longitudinal axis substantially parallel to the axis of rotation of the unitary drum shaft, the batten having an internal diameter substantially similar to an external diameter of the one or more hollow drums having spooled thereupon the elongate member, the motor being disposed at a first end of the batten; and an acme screw fixed to the batten and coupled by a threaded connection to the unitary drum shaft for imparting the longitudinal motion on the first drum, the threaded connection corresponding to threads of the acme screw, a pitch of the respective threads further corresponding to a pitch of the grooves of the one or more hollow drums, such that upon rotation of the unitary drum shaft, respective positions of the opening in the batten and a current entry point of each elongate member into the groove of the one or more drums remain adjacent to one another without lateral deviation therebetween during operation of the hoist system.

18. The hoist of claim 17, further comprising:

first and second drum shafts coupled by a shaft coupling to form the unitary drum shaft.

* * * * *